United States Patent [19]

Yamamoto

[11] Patent Number: 4,603,991

[45] Date of Patent: Aug. 5, 1986

[54] CONNECTOR FOR PROPELLING PENCIL

[75] Inventor: Ken Yamamoto, Saitama, Japan

[73] Assignee: Kotobuki & Co., Ltd., Kyoto, Japan

[21] Appl. No.: 406,965

[22] Filed: Aug. 10, 1982

[51] Int. Cl.[4] ..... B43K 21/24

[52] U.S. Cl. ..... 401/86; 401/65; 401/94; 401/251

[58] Field of Search ..... 401/86, 94, 198, 199, 401/65, 251, 109

[56] References Cited

U.S. PATENT DOCUMENTS

| | | | |
|---|---|---|---|
| 1,442,817 | 1/1923 | Moore | 401/86 X |
| 2,544,759 | 3/1951 | Johnson | 401/86 |
| 3,462,232 | 8/1969 | Longarzo | 401/109 X |
| 4,341,482 | 7/1982 | Wollensak | 401/199 |

FOREIGN PATENT DOCUMENTS

| | | | |
|---|---|---|---|
| EP93815 | 11/1983 | European Pat. Off. | 401/94 |
| 1511405 | 7/1969 | Fed. Rep. of Germany | 401/198 |
| 2034500 | 2/1971 | Fed. Rep. of Germany | 401/94 |

*Primary Examiner*—Steven A. Bratlie

*Attorney, Agent, or Firm*—Sherman and Shalloway

[57] ABSTRACT

A propelling pencil comprising an outer cylinder made of synthetic resin which can be easily molded as a unitary structure and an engaging member incorporating a chuck device including a lead propelling mechanism, the engaging member being detachably inserted into the outer cylinder from the rear side thereof, and thereby providing excellent appearance and light-touching operation.

2 Claims, 2 Drawing Figures

CONNECTOR FOR PROPELLING PENCIL

BACKGROUND OF THE INVENTION

This invention relates to a propelling pencil, and more specifically to the improvement in the knock-type propelling pencil.

Knock-type propelling pencils heretofore produced are constructed in a variety of ways. Efforts have been made to construct them as simply as possible to reduce the manufacturing cost.

However, the outer cylinder and the cap for accommodating a lead chuck device have been separately constructed so that they can be detachably attached. Otherwise, a cumbersome operation is required for assembling the pencil. This fact makes it difficult to produce the outer cylinder, which is constructed as a unitary structure, at a reduced cost, and the chuck device which will be mounted in the outer cylinder. Furthermore, an additional part is required to secure the inner cylinder accommodating the chuck device to the outer cylinder.

SUMMARY OF THE INVENTION

One general object of this invention, therefore, is to provide a new and improved propelling pencil in which the conventional defects are obviated.

More specifically, it is an object of this invention to provide a propelling pencil having excellent appearance, which comprises a unitarily molded outer cylinder that can be produced at a reduced cost, and an engaging member which promises light-touching operation.

According to this invention, a propelling pencil comprises an outer cylinder composed of a synthetic resin molded as a unitary structure which will be gripped during writing and which has at least one engaging hole formed in the periphery on the front side thereof, a cup-shaped resilient engaging member which has, on the outer peripheral rear portion, at least one tapered protrusion that engages said engaging hole, and which has an inner flange at the front end thereof, a lead chuck which is slidably inserted in the engaging member, and which is attached to an end of a lead pipe, a chuck-fastening tube loosely fitted to a chuck portion at the end of the lead chuck and a spring which is disposed between said inner flange and one end of said lead pipe, and which so urges the lead chuck that the chuck portion is squeezed by the chuck-fastening tube.

Other features and advantages of this invention will be more apparent from the detailed description by way of the embodiment with the accompanying drawings.

DESCRIPTION OF A PREFERRED EMBODIMENT

An embodiment of the invention will be described below in conjunction with the drawings.

Figure 1:
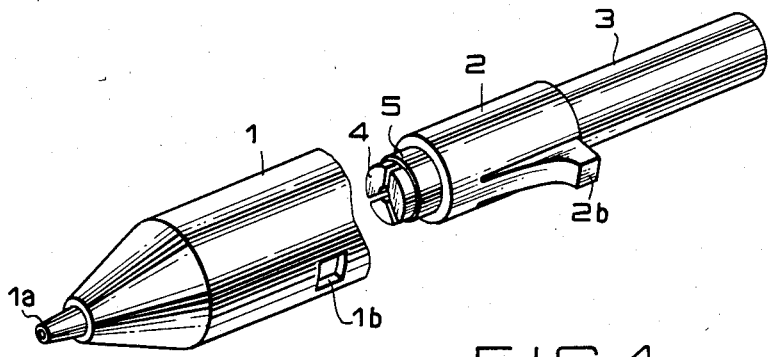
FIG. 1 is a perspective view showing an embodiment of this invention in a disassembled manner.
Figure 2:
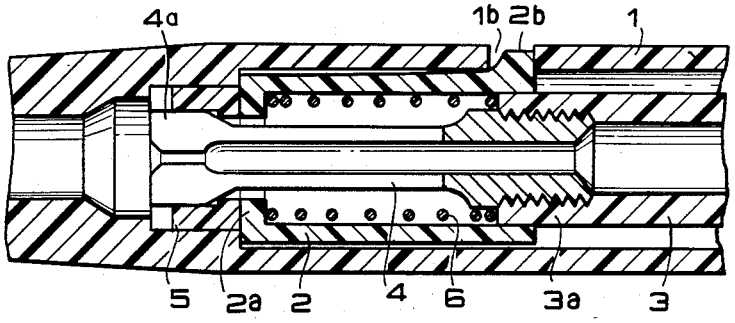
FIG. 2 is a section view showing major portions of FIG. 1.

FIGS. 1 and 2 are a perspective view showing a knock-type propelling pencil according to the embodiment of this invention in a disassembled manner, and a section view illustrating major portions thereof, in which reference numeral 1 denotes an outer cylinder composed of a synthetic resin of a good quality, which is molded as a unitary structure and which will be gripped by a person who writes. The outer cylinder 1 has a core guide hole 1*a* in a tip portion thereof and an engaging hole 1*b* in the outer peripheral portion thereof.

In the outer cylinder 1 is placed a cup-shaped resilient engaging member 2 which has, on the peripheral rear end portion thereof, a tapered protrusion 2*b* that engages said engaging hole 1*b*, and an inner flange 2*a* at an end portion thereof. In the engaging member 2 is slidably inserted a lead pipe 3. A chuck-fastening tube 5 has been fitted to a chuck portion 4*a* at the end of a lead chuck 4 that is attached to an end 3*a* of the lead pipe 3.

A spring 6 is interposed between the inner flange 2*a* and the end 3*a* of the lead pipe 3, and so urges the lead chuck 4 that the chuck portion 4*a* is squeezed by the chuck-fastening tube 5.

Further, the engaging member 2 and the lead chuck 4 may be assembled together as a unitary structure, the lead chuck 4 being provided with a lead pipe 3 with a chuck-fastening tube 5 being fitted thereto via a spring.

The above assembly is inserted in the outer cylinder 1 from the side of the rear end overcoming the resilient force of the tapered protrusion 2*b* which will then engage the engaging hole 1*b*.

According to this invention as mentioned above, the assembly is incorporated into the outer cylinder 1 by simply driving it from the rear side in such a manner that the tapered protrusion 2*b* engages the engaging hole 1*b*. To disassemble the device, the tapered protrusion 2*b* protruding through the engaging hole 1*b* is simply pushed by a pin or the like, and the assembly should be pulled rearwards.

The lead in the knock-type propelling pencil can be propelled in the same manner as the conventional propelling operation. That is, the engaging member 2 is detachably attached to the outer cylinder 1. Therefore, when the lead pipe 3 is pressed from the rear direction, the lead chuck 4 holding the lead is pushed forward to release the chuck-fastening tube 5 which is fitted to the chuck 4*a*, whereby the lead is released. When the pressing is discontinued, the spring 6 so urges the lead chuck 4 that the core is gripped again. By repeating this operation, the lead is propelled through the lead guide hole 1*a*.

In the above-mentioned embodiment, a tapered protrusion which works as a resilient piece is formed on the outer periphery of the cup-shaped engaging member 2. The tapered protrusions, however, may be provided in a plurality of numbers at symmetrical positions on the outer periphery.

When a plurality of tapered projections are provided as mentioned above, a plurality of engaging holes should be formed in the outer cylinder 1 correspondingly. Further, as a modified example of the engaging member, a plurality of slits may be formed in the outer peripheral portion of the cup-shaped engaging member to impart resiliency, and the tapered protrusions may be formed at the outer peripheral rear ends.

According to the knock-type propelling pencil of this invention as mentioned above, the outer cylinder is composed of a synthetic resin which can be easily molded as a unitary structure, and the engaging member incorporating the chuck device which includes a lead-propelling mechanism, is detachably inserted into the outer cylinder from the rear side thereof. Therefore, the pencil can be simply constructed, and manufactured at a reduced cost. In order to further reduce the number of parts, the chuck-fastening tube and the engaging member may be molded as a unitary structure.

What is claimed is:

1. A mechanical pencil comprising:

an outer cylinder (1) of a unitary cylindrical synthetic resin-molded structure having at least one engaging hole (1*b*) formed in the wall of the front portion thereof and a form suitable for being gripped between a user's fingers;

a lead pipe (3) slidably contained within the outer cylinder (1);

a lead chuck (4) fixed to the extremity of the lead pipe (3);

a chuck fastening tube (5) movably fitted on the head of the lead chuck (4);

an engaging member (2) adapted to abut the rear end of the chuck fastening tube (5) to restrict the movement of the chuck fastening tube (5); and a spring disposed resiliently between an inner flange (2*a*) formed in the extremity of the engaging member (2) and the lead pipe (3); wherein at least one protrusion (2*b*) for engaging the engaging hole (1*b*) is formed in the periphery of the rear portion of the engaging member (2).

2. A pencil as claimed in claim 1, wherein said protrusion (2*b*) of said engaging member (2) is provided with a tapered portion and said engaging hole (1*b*) is a through hole.

* * * * *